US008399170B2

(12) United States Patent
Iwase et al.

(10) Patent No.: US 8,399,170 B2
(45) Date of Patent: Mar. 19, 2013

(54) PROCESS FOR PRODUCTION OF LIQUID DEVELOPER, AND LIQUID DEVELOPER PRODUCED BY THE PROCESS

(75) Inventors: Koji Iwase, Osaka (JP); Hirohito Maeda, Osaka (JP); Takaaki Yodo, Osaka (JP)

(73) Assignee: Sakata Inx Corp., Osaka (JP)

( * ) Notice: Subject to any disclaimer, the term of this patent is extended or adjusted under 35 U.S.C. 154(b) by 707 days.

(21) Appl. No.: 11/993,065

(22) PCT Filed: Jun. 26, 2006

(86) PCT No.: PCT/JP2006/312719

§ 371 (c)(1),
(2), (4) Date: Dec. 19, 2007

(87) PCT Pub. No.: WO2007/000974

PCT Pub. Date: Jan. 4, 2007

(65) Prior Publication Data

US 2010/0136475 A1 Jun. 3, 2010

(30) Foreign Application Priority Data

Jun. 27, 2005 (JP) ..... 2005-186880

(51) Int. Cl.
*G03G 9/00* (2006.01)

(52) U.S. Cl. ..... 430/116; 430/137.22

(58) Field of Classification Search ..... 430/116, 430/137.22

See application file for complete search history.

(56) References Cited

U.S. PATENT DOCUMENTS

| | | | | |
|---|---|---|---|---|
| 2004/0094067 | A1* | 5/2004 | Oyanagi et al. | 106/31.58 |
| 2006/0166126 | A1* | 7/2006 | Iwase et al. | 430/114 |
| 2006/0276564 | A1* | 12/2006 | Marko | 523/161 |
| 2007/0189998 | A1* | 8/2007 | Nair et al. | 424/63 |

FOREIGN PATENT DOCUMENTS

| | | | |
|---|---|---|---|
| JP | 5-273792 | | 10/1993 |
| JP | 9-302259 | | 11/1997 |
| JP | 2002-139871 | A | 5/2002 |
| JP | 2003-241439 | A | 8/2003 |
| JP | 2005-91800 | A | 4/2005 |
| JP | 2005-186113 | | 7/2005 |
| WO | WO 03/007652 | A1 | 1/2003 |
| WO | WO 04/000950 | A1 | 12/2003 |
| WO | WO 2004/003085 | A1 | 1/2004 |

OTHER PUBLICATIONS

International Search Report; International Application No. PCT/JP2006/312719; Date of mailing of the international search report: Oct. 24, 2006.

International Preliminary Report on Patentability; International Application No. PCT/JP2006/312719; International Filing Date: Jun. 26, 2006.

Written Opinion; International Application No. PCT/JP2006/312719; International Filing Date: Jun. 26, 2006.

* cited by examiner

*Primary Examiner* — Thorl Chea

(74) *Attorney, Agent, or Firm* — Antonelli, Terry, Stout & Kraus, LLP.

(57) ABSTRACT

Production process for a liquid developer for use in electrophotograph or electrostatic recording by coacervation method. The process can produce a liquid developer in which a coloring agent (e.g., a pigment) is included completely within a resin particle by distillation of a solvent while retaining the state where the coloring agent is finely dispersed and the resulting colored resin particle is small in particle size with excellent dispersion stability, and excellent optical properties.

9 Claims, No Drawings

PROCESS FOR PRODUCTION OF LIQUID DEVELOPER, AND LIQUID DEVELOPER PRODUCED BY THE PROCESS

RELATED APPLICATION

This is a U.S. national phase application under 35 U.S.C. §371 of International Application No. PCT/JP2006/312719 filed Jun. 26, 2006, claiming priority of Japanese Patent Application No. 2005-186880 filed Jun. 27, 2005.

TECHNICAL FIELD

The present invention relates to a process for production of liquid developers for electrophotography and electrostatic recording used in a printing machine, copier, printer and facsimile, and a liquid developer obtained by the process for production.

BACKGROUND ART

Generally, liquid developers are used in a form that colored resin particles containing a coloring agent such as a pigment are dispersed in an electrically insulating medium. As the process for production of such liquid developers, there are various methods such as (1) polymerization method where monomer components are polymerized in an electrically insulating medium with a coloring agent being dispersed therein to form colored resin particles; (2) wet pulverization method where after kneading a coloring agent and resin at a temperature not less than the melting point of the resin, dry pulverization is conducted, and the pulverized powder is subjected to wet pulverization under the presence of a dispersing agent in an electrically insulating medium; and (3) precipitation method (coacervation method) where from a mixture of a coloring agent, a resin, a solvent which can dissolve the resin and an electrically insulating medium which cannot dissolve the resin, said solvent is removed to cause the resin to precipitate, whereby a colored resin particle is dispersed in the electrically insulating medium.

However, the polymerization method (1) has a problem that it requires a step for eliminating residual monomers after polymerization. Further, the wet pulverization method (2) has a problem that since coloring agents are not completely contained in a resin, coloring agents aggregate together to result in a nonuniform particle size of colored resin particle, the resultant liquid developer is insufficient in dispersion stability and optical properties. Moreover, the precipitation method (3) has a problem that coloring agents aggregate together in precipitation of resin, making a particle bulky, and the same problem as in the wet pulverization method (2) that the resultant liquid developer is insufficient in dispersion stability and optical properties.

In view of the situations, in order to solve the above-described problems in the precipitation method (3), there has been proposed a method that after dissolving a resin in a solvent capable of solving the resin, mixed with an electrically insulating medium in the coexistence of a coloring agent and a dispersing agent, further, the solvent is removed from the mixture, thereby to disperse colored resin particles in the electrically insulating medium (see Japanese Unexamined Patent Publication No. 2003-241439).

In the progress of various printing technologies, however, to compete with other methods and obtain advantages, in recent liquid developers, high concentration of the liquid developer itself and high-resolution image of printing have increasingly become the most desired performances. Hence, to satisfy these required performances, colored resin particles must be minute and concentrated, but now it is the extremely difficult techniques to produce a minute colored resin particle and also to disperse it stably at high concentration, there have been desired a process for production of a new liquid developer to realize them.

DISCLOSURE OF INVENTION

It is an object of the present invention to provide a process for production capable of obtaining a liquid developer, in which a liquid developer such as a pigment is completely contained within a resin particle by distillation of a solvent, while retaining the state where the coloring agent is finely dispersed and the resultant colored resin particle is small in particle size, has an excellent dispersion stability and excellent optical properties under producing the liquid developer for electrophotography and electrostatic recording by coacervation method.

The present inventors have variously studied on processes for the production of liquid developers, as a result, have found the knowledge and completed the present invention as follows; in a coacervation method for production of colored resin particles, a liquid developer which solves all the above-described problems can be obtained by using concomitantly specific two kinds of dispersing agents as the dispersing agent.

Namely, the present invention provides the following process for production of a liquid developer and the liquid developer obtained thereby.

[1] A process for production of a liquid developer, including preparing a mixture containing a pigment, a resin having a fixability, a solvent (A) which can dissolve the resin therein, a hydrocarbon solvent (B) which cannot dissolve the resin therein and has an SP (solubility parameter) value lower than that of the solvent (A), at least one dispersing agent (A) which is soluble in both the solvent (A) and the solvent (B), and at least one dispersing agent (B) which is soluble in the solvent (A) but insoluble or poorly soluble in the solvent (B), and distilling away the solvent (A) from the mixture to cause the resin dissolved in the mixture to precipitate, whereby a colored resin particle including the pigment therein is dispersed in the solvent (B).

[2] The process for production of a liquid developer described in the [1], wherein the solvent (A) has an SP value of not less than 8.5, and the solvent (B) has an SP value of less than 8.5.

[3] The process for production of a liquid developer described in the [1] or [2], wherein the dispersing agent (A) and the dispersing agent (B) are concomitantly used so that the mass ratio in the liquid developer is dispersing agent (A): dispersing agent (B)=99:1 to 1:99.

[4] The process for production of a liquid developer described in any one of the [1] through [3], wherein a high boiling point paraffin solvent is used as the solvent (B).

[5] A liquid developer produced by a process for production described in any one of the [1] through [4].

Herein, "containing" means that a pigment particle is completely covered with a resin, and no pigment particle is present on the surface of the resin particle.

Additionally, a pigment in the present invention does not contain the pigment with a hybrid type core-shell structure that the surface of an inorganic pigment is covered with an organic pigment or carbon black, described in Patent Application No. 2005-186113 dated on the same day as the present patent application.

BEST MODE FOR CARRYING OUT THE INVENTION

The process for production of a liquid developer of the present invention, and the liquid developer obtained by the process will be described in detail below.

The process for production of a liquid developer of the present invention is characterized by including preparing a mixture containing a pigment, a resin having fixability, a solvent (A) which can dissolve the resin therein, a hydrocarbon solvent (B) which cannot dissolve the resin therein and has an SP value lower than that of the solvent (A), at least one dispersing agent (A) which is soluble in both the solvent (A) and the solvent (B), and at least one dispersing agent (B) which is soluble in the solvent (A) but insoluble or poorly soluble in the solvent (B), and distilling away the solvent (A) from the mixture to cause the resin dissolved therein to precipitate, whereby a colored resin particle having the pigment contained therein is dispersed in the solvent (B).

In the present invention, as the pigment contained in a colored resin particle, it is not particularly limited, any general pigment can be used, for example, including inorganic pigments such as carbon black such as acetylene black, graphite, colcothar, chrome yellow and ultramarine blue; and organic pigments such as azo pigments, condensed azo pigments, lake pigments, phthalocyanine pigments, isoindoline pigments, anthraqunone pigments and qunacridone pigments. Regarding various kinds of hues of organic pigments, as magenta-type organic pigments, there are listed qunacridone pigments such as qunacridone red, azo pigments such as permanent red, condensed azo pigments such as condensed azo red, and perylene pigments such as perylene red. As cyanogen-type organic pigments, there are listed phthalocyanine pigments such as metal-free phthalocyanine blue, phthlocyanine blue and fast sky blue. As yellow-type organic pigments, there are listed monoazo pigments such as hansa yellow, disazo pigments such as benzene yellow and permanent yellow, and condensed azo pigments such as condensed azo yellow. As green-type pigments, phthalocyanine pigments such as phthalocyanine green are listed. These pigments are used alone or in mixture of at least 2 kinds thereof.

The content of pigment in the present invention is not particularly limited; it is preferably 1 to 20% by mass in the final liquid developer from the point of image density.

Next, as the resin used in the present invention, it is preferably a thermoplastic resin having fixability to adherends such as paper and plastic film, specifically, there are listed olefin resins such as a modified polyolefin resin in which a carboxyl group is introduced, ethylene-(meth)acrylic acid copolymer, ethylene-vinyl acetate copolymer, partially saponified ethylene-vinyl acetate copolymer, ethylene-(meth)acrylate copolymer, polyethylene resin and polypropylene resin; thermoplastic saturated polyester resin, styrene resins such as styrene-acryl copolymer resin and styrene-acryl-modified polyester resin, alkyd resin, phenol resin, epoxy resin, rosin-modified phenol resin, rosin-modified maleic acid resin, rosin-modified fumaric acid resin, acryl resins such as (meth)acrylate resin, vinyl chloride resin, vinyl acetate resin, vinylidene chloride resin, fluorine resin, polyamide resin, polyacetal reisn. These resins can be used alone or in combination of at least 2 kinds thereof.

Further, in the present invention, the solid content concentration occupied in a liquid developer is preferably 10 to 50% by mass, more preferably 15 to 40% by mass. When the solid content concentration is less than the above-described range, there is a tendency that an image concentration is not sufficient, whereas when more than the above-described range, there is a tendency that viscosity increases too much.

Next, as the solvent used in the present invention, a solvent (A) which can dissolve the resin and a hydrocarbon solvent (B) which cannot dissolve the resin and has an SP value lower than that of the solvent (A) are concomitantly used. The solvent (A) is preferably compatible with the solvent (B). In the present invention, as an index that a resin is soluble in the solvent (A) and insoluble in the solvent (B), it is possible to use solubility of a resin in the solvent (A) or the solvent (B). In the present invention, it is defined that a resin is soluble when solubility of a resin in the solvent (A) is not less than 1.0 g/100 g (solvent (A)) at 25° C., and insoluble when solubility of a resin in the solvent (B) is at most 1.0 g/100 g (solvent (B)) at 25° C. Here, solubility is a value that after filtering a solution dissolved up to dissolution limit, solid content rate of the filtrate is measured by a weight method.

As the solvent (A), the SP value is preferably not less than 8.5, a low boiling point solvent which is easily distilled away from a mixture by distillation is preferred, for example, there can be listed ethers such as tetrahydrofuran, ketones such as methyl ethyl ketone and cyclohexanone, and esters such as ethyl acetate, further, in the case where there is dissolving power of resin, aromatic hydrocarbons such as toluene and benzene can also be used. These solvents (A) can be used alone or in combination of at least 2 kinds thereof.

On the other hand, regarding the solvent (B), preferably it does not dissolve the above-described resin, has an electric insulation, an SP value lower than that of solvent (A) (preferable SP value is less than 8.5), and further preferably does not evaporate in distilling away the solvent (A), as the solvent satisfying such conditions, a non-volatility or low-volatility hydrocarbon is listed, and aliphatic hydrocarbons and alicyclic hydrocarbons are more preferable. Further, aromatic hydrocarbons and halogenated hydrocarbons can also be used as long as they do not dissolve the above-described resin and satisfy the above-described SP value. Among them, particularly preferable ones from the points of odor, harmlessness and cost are paraffin solvents with a high boiling point (boiling point is not less than 150° C.) such as normal paraffin solvents, isoparaffin solvents, cycloparaffin solvents, or a mixture of at least 2 kinds thereof. As their commercial products of paraffin solvents with a high boiling point such as normal paraffin solvents, isoparaffin solvents, cycloparaffin solvents, or a mixture thereof, there are listed, for example, Isopar G, Isopar H, Isopar L, Isopar M, Exxsol D130, and Exxsol D140 (all of them, manufactured by Exxon Chemical Corporation), Shellsol 71 (manufactured by Shell Sekiyu K.K.), IP Solvent 1620, IP Solvent 2080 and IP Solvent 2835 (all of them, manufactured by Idemitsu Kosan Co., Ltd.), Moresco White P-40, Moresco White P-55 and Moresco White P-80 (all f them, manufactured by Matsumura oil Co., Ltd.), Liquid paraffin No. 40-S and Liquid paraffin No. 55-S (all of them, manufactured by Chuokasei Co., Ltd.). These solvents (B) can be used alone or in combination of at least 2 kinds thereof.

Next, as the dispersing agent used in the present invention, a dispersing agent (A) which is soluble in both the solvent (A) and the solvent (B), and a dispersing agent (B) which is soluble in the solvent (A) but insoluble or poorly soluble in the solvent (B) are concomitantly used. In the present invention, as an index that a dispersing agent (A) is soluble in the solvent (A) and the solvent (B), and a dispersing agent (B) is soluble in the solvent (A) but insoluble or poorly soluble in the solvent (B), it is possible to use solubility of the dispersing agent (A) or the dispersing agent (B) in the solvent (A) or the solvent (B). In the present invention, it is defined that a dispersing agent is soluble when solubility of the dispersing agent (A) in the solvent (A) and the solvent (B) is not less than 1.0 g/100 g (solvent (A), solvent (B)) at 25° C., and when solubility of the dispersing agent (B) in the solvent (A) is not less than 1.0 g/100 g (solvent (A)) at 25° C.; and a dispersing agent is insoluble or poorly soluble when solubility of the dispersing agent (B) is less than 1.0 g/100 g (solvent (B)) at 25° C. Here, solubility is a value that after filtering a solution dissolved up to dissolution limit, solid content rate of the filtrate is measured by a weight method.

As such dispersing agents, known dispersing agents can be employed, and a combination of the dispersing agent (A) and the dispersing agent (B) is not particularly limited as long as they satisfy the respective conditions. However, there may be a possibility to obtain a different result for the same dispersing agent, depending on the solvents employed, which may correspond to the condition of the dispersing agent (A), may correspond to the condition of the dispersing agent (B), or may not correspond to the condition of the dispersing agent (A) nor the condition of the dispersing agent (B). Thus, at the point of deciding the solvent (A) and solvent (B), they should be classified through a preexamination into one satisfying the condition of the dispersing agent (A) and one satisfying the condition of the dispersing agent (B), and it is preferable to select a suitable combination among the respective ones classified in this way.

Incidentally, as candidates capable of being for the dispersing agent (A) or for the dispersing agent (B), specifically, there are listed various surfactants such as anionic surfactants, nonionic surfactants, cationic surfactants, amphoteric surfactants, silicone surfactants and fluorine surfactants and derivatives thereof; and polymer-type pigment dispersing resins such as polyurethane resins, modified novolak resins with an aromatic ring and a ring-opened structure of an epoxy group by a hydroxycarboxylic acid-derived carboxyl group (Japanese Unexamined Patent Publication No. Hei 9-302259 (1997)), an acryl copolymer with an aromatic ring and a ring-opened structure of an epoxy group by a hydroxycarboxylic acid-derived carboxyl group (Japanese Unexamined Patent Publication No. Hei 9-302259 (1997)), polyesters such as poly(hydroxycarboxylate), dispersing agent having a polar group such as a basic group at the terminal, (poly)amine derivatives in which a polyester group is introduced into an amino group and/or an imino group of a (poly)amine compound, a carbodiimide compound having a polyester side chain, a polyether side chain or a polyacryl side chain (International Publication WO No. 03/07652 pamphlet), a carbodiimide compound having a basic nitrogen-containing group and also having a polyester side chain, a polyether side chain or a polyacryl side chain in the side chain (International Publication WO No. 04/000950 pamphlet), and a carbodiimide compound having a side chain containing a pigment adsorbing part (International Publication WO No. 04/003085 pamphlet). As the commercial dispersing agents, for example, BYK-160, 162, 164, 182 (all of them, manufactured by BYK Chemie GmbH), EFKA-47, 4050 (all of them, manufactured by EFKA Corporation), SOLSPERSE 13940, 17000, 18000, 24000, 28000 (all of them, manufactured by Avecia Co., Ltd.), and AJISPER-PB-821 (manufactured by Ajinomoto Co., Inc.).

As the above-described modified novolak resin with an aromatic ring and a ring-opened structure of an epoxy group by a hydroxycarboxylic acid-derived carboxyl group, there is listed a modified novolak resin with an aromatic ring derived from the novolak resin, and at least one group based on ring-opening of an epoxy group by a hydroxycarboxylic acid-derived carboxyl group in a molecule shown by a general formula (1):

(1)

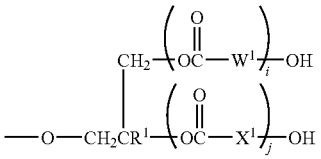

wherein an oxygen atom at the far left is derived from an oxygen atom contained in an aromatic hydroxyl group of a novolak resin, $W^1$ and $X^1$ each independently represent a divalent hydrocarbon group with carbon numbers of 1-19, i and j each independently represent an integer of i=1 to 30 and j=0 to 30, and $R^1$ represents a hydrogen atom or a methyl group.

The above-described modified novolak resin has at least one group shown by the general formula (1) in a molecule. The number of the groups by the general formula (1) in a molecule is preferably 1 to 20. Since it is very difficult to control the molecular weight of a novolak resin with the large functional group number, the sum of aromatic hydroxyl groups of the novolak resin (sum of unsubstituted and substituted aromatic hydroxyl groups, the same later) is preferably at most 20. The modified novolak resin may have groups other than the group shown by the general formula (1) in the aromatic hydroxyl group (e.g., a group with a structure in which an aromatic hydroxyl group is reacted with epichlorohydrin or β-methylepichlorohydrin, followed by reacting with a monovalent carboxylic acid).

In the general formula (1), a general formula (2):

$$\text{-}(OCOW^1)_i\text{-}OH \quad (2)$$

wherein $W^1$ and i are the same as described above, and a general formula (3):

$$\text{-}(OCOX^1)_j\text{-}OH \quad (3)$$

wherein $X^1$ and j are the same as described above, these groups can be derived from a hydroxycarboxylic acid with carbon numbers in a range of 2 to 20 that may have an unsaturated bond and/or branched structure (e.g., 12-hydroxystearic acid), or the mixture thereof or the polycondensate thereof.

As the above-described acryl copolymer having an aromatic ring and a ring-opened structure of an epoxy group by a hydroxycarboxylic acid-derived carboxyl group, there is listed a copolymer which is an acryl copolymer having a weight-average molecular weight of 3000 to 100000, in the copolymer, contains the amount corresponding to at least 10 mol % of the constituent unit shown by a general formula (4), and the amount corresponding to at least 10 mol % of at least one member selected from the constituent units shown by a general formula (5) and a general formula (6).

(4)

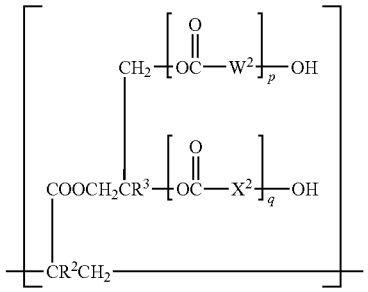

(5)

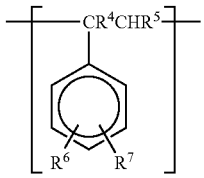

-continued (6)

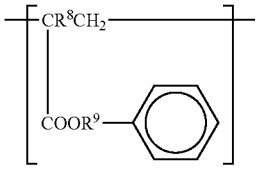

wherein $W^2$ and $X^2$ each independently represent a divalent hydrocarbon group with carbon numbers of 1-19, p and q each independently represent an integer of p=1 to 30, and q=0 to 30, $R^2$, $R^3$ and $R^4$ each independently represent a hydrogen atom or a methyl group, $R^5$ represents a hydrogen atom or a halogen atom, $R^6$ and $R^7$ each independently represent a hydrogen atom, a hydrocarbon group with carbon numbers of 1-5, an alkoxy group with carbon numbers of 1-5, an aryloxy group with carbon numbers of 6-10, or a halogen atom, $R^8$ represents a hydrogen atom or a methyl group, and $R^9$ represents a direct bond or a methylene group.

In the general formula (4), a general formula (7):

$$-[OCOW^2]_pOH \quad (7)$$

wherein $W^2$ and p are the same as described above, a general formula (8):

$$-[OCOX^2]_qOH \quad (8)$$

wherein $X^2$ and q are the same as described above, these groups can be derived from hydroxycarboxylic acid with carbon numbers in a range of 2 to 20 that may have an unsaturated bond and/or branched structure (e.g., 12-hydroxystearic acid), or the mixture thereof or the polycondensate thereof.

In the present invention, the preferable use-amount ratio of the dispersing agent (A) and dispersing agent (B) tends to differ depending on the performance of respective dispersing agents themselves and also a combination of a solvent, generally, mass ratio of dispersing agent (A):dispersing agent=about 99:1 to 1:99 is preferable, and 95:5 to 5:95 is more preferable. When the use-amount ratio of the dispersing agent (A) and dispersing agent (B) is outside the above-described range, a concomitant use effect tends not to be exhibited sufficiently. Further, the total use-amount of the dispersing agent (A) and dispersing agent (B) is preferably 0.1 to 200% by mass based on the pigment in the liquid developer, more preferably 10 to 100% by mass. When the total use-amount of the dispersing agent (A) and dispersing agent (B) is less than the above-described range, a colored resin particle tends to be bulky, whereas when more than the above-described range, viscosity tends to increase too much.

The liquid developer obtained by the process of the present invention may contain other additives such as charge controlling agents according to need in addition to the aforementioned materials.

The charge controlling agents are broadly classified into two types of (1) and (2) which will be explained below.

(1) A type of covering the surface of a colored resin particle (toner particle) with a substance capable of ionization or adsorption of ion; the preferable one of this type includes fat such as linseed oil and soy oil, an alkyd resin, a halogenated polymer, an aromatic polycarboxylic acid, an acid group-containing aqueous dye, and an oxidized condensate of an aromatic polyamine.

(2) A type of coexisting with a substance capable of giving and receiving ions with a colored resin particle (toner particle) by dissolving in an electrically insulating solvent; the preferable one of this type includes metal soap such as cobalt naphthenate, nickel naphthenate, iron naphthenate, zinc naphthenate, cobalt octylate, nickel octylate, zinc octylate, cobalt dodecanoate, nickel dodecanoate, zinc dodecanoate, cobalt 2-ethylhexanoate; metal sulfonates such as petroleum-metal sulfonate and metal salt of sulfosuccinate; phospholipids such as lecithin; metal salicylates such as t-butylsalicylic acid metal complex; polyvinylpyrolidone resin, polyamide resin, sulfonic acid group-containing resin and hydroxybenzoic acid derivative.

Next, a process for production of a liquid developer using the foregoing materials is explained. However, the process explained below is one example of preferable examples of the present invention, and the present invention is not limited thereto.

First, preparation of a mixture in the present invention is explained, For example, a pigment, a dispersing agent (A), a dispersing agent (B) and a part of the solvent (A) are blended, and a pigment-dispersed liquid is obtained by using media-type powdering machines such as atoreiter, ball mill, sand mill and bead mill; or media-free powdering machines such as high-speed mixer and high-speed homogenizer. Further, to the pigment-dispersed liquid, a resin and the residue of the solvent (A) are added, then the solvent (B) is added thereto while stirring by a high-speed shearing stirrer, a mixture can be obtained thereby. Additionally, in preparing the above-described pigment-dispersed liquid, a pigment may be dispersed after a resin is added beforehand. In the pigment-dispersed liquid, a resin, the dispersing agent (A) and the dispersing agent (B) are in a dissolved state in a mixture of the solvent (A) and the solvent (B).

Next, while stirring the above-described mixture by a high-speed shearing stirrer, distilling away the solvent (A) can give a liquid developer of the present invention. Further, when solid content concentration in the resultant liquid developer is high, the solvent (B) may be added up to a required solid content concentration. Moreover, according to need, other additives such as a charge controlling agent may be added. Additionally, a liquid developer of the present invention may be obtained by distilling away the solvent (A) and adding the solvent (B) simultaneously.

As the high-speed shearing stirrer, a homogenizer, or homogenizing mixer applying stirring and shear force can be adopted. There are various types thereof in capacity, rotation number, and model, suitable equipment may be used according to the form of production. Additionally, in the case of using a homogenizer, the rotation number is preferably not less than 500 rpm.

By the process of production described above, there can be obtained a liquid developer that a resin particle containing a pigment dispersed in an electrically insulating solvent is small in particle size, and dispersion stability is excellent and optical properties are also excellent. The liquid developer thus obtained can be used in the field such as printing machine, copier, printer and facsimile, and since the viscosity can be maintained as sufficiently low as being suitable for printing even in the high concentration of solid content of colored resin particle, it has high-speed printability and rapid drying property, and further has a feature capable of realizing a high-resolution image.

From the point of obtaining a highly precise image, the colored resin particle in the liquid developer of the present invention preferably has a mean particle size of 0.1 to 5.0 μm, more preferably 0.1 to 3.0 μm

EXAMPLES

The liquid developer of the present invention will be described further in detail with reference to Examples below, however the present invention is not limited thereto.

Additionally, in the following descriptions, "part" and "%" mean "part by mass" and "% by mass", respectively.

The pigment, dispersing agent and fixable thermoplastic resin used in the following Examples and Comparative examples are explained.

<Pigment>

127EPS (phthalocyanine blue; manufactured by Dainichiseika Color & Chemicals Mfg. Co., Ltd.)

<Dispersing Agent 1>

In a reactor was charged a mixture of 30 parts of an epoxy-modified novolak resin (manufactured by Japan Epoxy Resins Co., Ltd; Epicoat 154), 75 parts of polyester with an acid value of 30 and weight-average molecular weight of 4500 obtained by polycondensation of 12-hydroxystearic acid, 35 parts of stearic acid and 0.2 part of tetraethylamonium bromide. Next, the mixture was heated and stirred at 130-150° C. under nitrogen stream for 3 hours, then the catalyst was removed by vacuum filtration to give a modified novolak resin with a weight-average molecular weight of 8000.

The solubility of the dispersing agent 1 in tetrahydrofuran was not less than 1.0 g/100 g. The solubility of the dispersing agent 1 in Moresco White P-80 (liquid paraffin) was not less than 1.0 g/100 g.

<Dispersing Agent 2>

A commercial product AJISPER PB821 (manufactured by Ajinomoto Co., Inc.; amine value of 8 to 10) was used. AJISPER PB821 corresponds to a (poly)amine derivative in which a polyester group is introduced in an amino group and/or an imino group of a (poly)amine compound.

The solubility of the dispersing agent 2 in tetrahydrofuran was not less than 1.0 g/100 g. The solubility of the dispersing agent 2 in Moresco White P-80 (liquid paraffin) was less than 0.01 g/100 g (measuring limit).

<Dispersing Agent 3>

A commercial product SOLSPERSE 13940 (manufactured by Avecia Co., Ltd.; amine value of 80 to 90) was used. SOLSPERSE 13940 corresponds to a (poly)amine derivative in which a polyester group is introduced in an amino group and/or an imino group of a (poly)amine compound.

The solubility of the dispersing agent 3 in tetrahydrofuran was not less than 1.0 g/100 g. The solubility of the dispersing agent 3 in Moresco White P-80 (liquid paraffin) was not less than 1.0 g/100 g.

<Thermoplastic Resin>

Epoxy resin (AER6064, manufactured by Asahi Kasei Corporation) was used.

The solubility of the epoxy resin in tetrahydrofuran was not less than 1.0 g/100 g. The solubility of the epoxy resin in Moresco White P-80 (liquid paraffin) was less than 0.01 g/100 g (measuring limit).

Example 1

10 Parts of 127EPS, 1 part of the above-described dispersing agent 1 as the dispersing agent (A), 1 part of the above-described dispersing agent 2 as the dispersing agent (B), 88 parts of tetrahydrofuran (SP value of 9.1, hereinafter referred to as "THF") were mixed, kneaded for 15 minutes by a paint shaker using steel beads of 5 mm in diameter, then, further kneaded for 2 hours using Eiger mill (M-250) filled with zirconia beads of 0.5 mm diameter. To 50 parts of this kneaded material, 14 parts of the thermoplastic resin was added, and then a mixture was diluted with 36 parts of THF. By stirring while diluting the diluted material with 80 parts of Moresco White P-80 (manufactured by Matsumura oil Co., Ltd.; SP value of at most 8.5), a mixture was obtained. Next, using an apparatus in which a solvent-distilling apparatus (connected to a vacuum apparatus) is connected to a homogenizer constituted by a tight seal-type stirring tank, the mixture was vacuumed by the vacuum apparatus so as to increase a mixture to 50° C. while stirring the mixture at high speed (rotation number 5000 rpm) by the homogenizer, THF was completely distilled away from the tight seal-type stirring tank, thereby to give a liquid developer (solid content concentration 20%) of Example 1.

Example 2

10 parts of 127EPS, 1 part of the above-described dispersing agent 3 as the dispersing agent (A), 1 part of the above-described dispersing agent 2 as the dispersing agent (B), 88 parts of THF were mixed, kneaded for 15 minutes by a paint shaker using steel beads of 5 mm in diameter, then, further kneaded for 2 hours using Eiger mill (M-250) filled with zirconia beads of 0.5 mm diameter. To 50 parts of this kneaded material, 13 parts of the thermoplastic resin was added, and then a mixture was diluted with 37 parts of THF. By stirring while diluting the diluted material with 80 parts of Moresco White P-80, a mixture was obtained. Next, using an apparatus in which a solvent-distilling apparatus (connected to a vacuum apparatus) is connected to a homogenizer constituted by a tight seal-type stirring tank, the mixture was vacuumed by the vacuum apparatus so as to increase a mixture to 50° C. while stirring the mixture at high speed (rotation number 5000 rpm) by the homogenizer, THF was completely distilled away from the tight seal-type stirring tank, thereby to give a liquid developer (solid content concentration 20%) of Example 2.

Example 3

20 Parts of 127EPS, 1 part of the above-described dispersing agent 1 as the dispersing agent (A), 1 part of the above-described dispersing agent 2 as the dispersing agent (B), 78 parts of THF were mixed, kneaded for 15 minutes by a paint shaker using steel beads of 5 mm in diameter, then, further kneaded for 2 hours using Eiger mill (M-250) filled with zirconia beads of 0.5 mm diameter. To 50 parts of this kneaded material, 19 parts of the thermoplastic resin was added, and then a mixture was diluted with 31 parts of THF. By stirring while diluting the diluted material with 70 parts of Moresco White P-80, a mixture was obtained. Next, using an apparatus in which a solvent-distilling apparatus (connected to a vacuum apparatus) is connected to a homogenizer constituted by a tight seal-type stirring tank, the mixture was vacuumed by the vacuum apparatus so as to increase a mixture to 50° C. while stirring the mixture at high speed (rotation number 5000 rpm) by the homogenizer, THF was completely distilled away from the tight seal-type stirring tank, thereby to give a liquid developer (solid content concentration 30%) of Example 3.

Comparative Example 1

10 Parts of 127EPS, 1 part of the above-described dispersing agent 2 as the dispersing agent (B), and 89 parts of THF were mixed, kneaded for 15 minutes by a paint shaker using steel beads of 5 mm in diameter, then, further kneaded for 2 hours by an ultra apex mill using zirconia beads of 0.05 mm diameter. To 50 parts of this kneaded material, 14.5 parts of the thermoplastic resin was added, and then a mixture was diluted with 35.5 parts of THF. By stirring while diluting the diluted material with 80 parts of Moresco White P-80, a mixture was obtained. Next, using an apparatus in which a solvent-distilling apparatus (connected to a vacuum apparatus) is connected to a homogenizer constituted by a tight seal-type stirring tank, the mixture was vacuumed by the vacuum apparatus so as to increase a mixture to 50° C. while stirring the mixture at high speed (rotation number 5000 rpm) by the homogenizer, THF was completely distilled away from the tight seal-type stirring tank. However, since aggregate was generated, a liquid developer was not able to be obtained, and performance evaluation was not conducted any more.

Comparative Example 2

A liquid developer was tried to obtain in the same manner as in Example 1 except that the dispersing agent (A) and the dispersing agent (B) were not used in Example 1, but, since aggregate was generated, a liquid developer was not able to be obtained, and performance evaluation was not conducted any more.

<Evaluation Method>

Each of liquid developers was evaluated by the following methods. The results are shown in Table 1.

(Viscosity)

Viscosity at 25° C. was measured as a viscosity after 60 seconds by an E-type viscometer (50 rpm).

(Mean Volume Particle Size D50 of Colored Resin Particle)

It was measured using a particle size analyzer, Microtrack UPA (manufactured by Honeywell International Inc.).

(Condition of Colored Resin Particle)

Using an optical microscope BH-2 (manufactured by Olympus Corporation), complete containing of a colored resin particle was confirmed.

TABLE 1

| | Dispersing agent used | Viscosity (mPa · s) | Mean particle size (μm) | Condition of colored resin particle |
|---|---|---|---|---|
| Ex. 1 | (A) Dispersing agent 1<br>(B) Dispersing agent 2 | 40 | 1.5 | Contained completely |
| Ex. 2 | (A) Dispersing agent 3<br>(B) Dispersing agent 2 | 40 | 1.5 | Contained completely |
| Ex. 3 | (A) Dispersing agent 1<br>(B) Dispersing agent 2 | 100 | 1.5 | Contained completely |
| Com. Ex. 1 | (A) None<br>(B) Dispersing agent 2 | (Note) | (Note) | (Note) |
| Com. Ex. 2 | (A) None<br>(B) None | (Note) | (Note) | (Note) |

(Note): Evaluation was not able to be done because of no liquid developer obtained.

INDUSTRIAL APPLICABILITY

According to the present invention, it becomes possible to contain a pigment in a colored resin particle completely while retaining the pigment in a dispersed state finely, further, to disperse the colored resin particle in an electrically insulating medium finely and more stably. Namely, it is possible to obtain a liquid developer that a colored resin particle containing a coloring agent such as pigment dispersed in an electrically insulating medium is small in particle size, has an excellent dispersion stability and excellent optical properties.

The liquid developer obtained by the process for production of the present invention maintains viscosity as sufficiently low as being suitable for printing even in a high solid content, further, has a feature capable of realizing high-resolution image, a high-speed printing capability and rapid drying property in an electrophotography or electrostatic recording field, moreover, exhibits an effect obtaining a highly precise image.

The invention claimed is:

1. A process for production of a liquid developer, which comprises:

mixing a pigment, a dispersing agent (A) which is soluble in both a solvent (A) and a solvent (B), a dispersing agent (B) which is soluble in the solvent (A) but insoluble or poorly soluble in the solvent (B), and a part of the solvent (A) to obtain a mixed dispersing liquid, adding and mixing a resin and the residue of the solvent (A) into the mixed dispersing liquid, followed by mixing a hydrocarbon solvent (B) which cannot dissolve said resin and has an SP value lower than that of the solvent (A) to obtain a mixture, and distilling away the solvent (A) from the mixture, whereby said resin dissolved therein is caused to be precipitated, so that a colored resin particle including the pigment therein is dispersed in the solvent (B).

2. The process for production of a liquid developer of claim 1, wherein said solvent (A) has an SP value of not less than 8.5, and said solvent (B) has an SP value of less than 8.5.

3. The process for production of a liquid developer of claim 2, wherein said dispersing agent (A) and said dispersing agent (B) are concomitantly used so that the mass ratio in the liquid developer is dispersing agent (A): dispersing agent (B)=99:1 to 1:99.

4. The process for production of a liquid developer of claim 3, wherein a high boiling point paraffin solvent is used as said solvent (B).

5. The process for production of a liquid developer of claim 1, wherein said dispersing agent (A) and said dispersing agent (B) are concomitantly used so that the mass ratio in the liquid developer is dispersing agent (A): dispersing agent (B)=99:1 to 1:99.

6. The process for production of a liquid developer of claim 5, wherein a high boiling point paraffin solvent is used as said solvent (B).

7. The process for production of a liquid developer of claim 1 wherein a high boiling point paraffin solvent is used as said solvent (B).

8. The process for production of a liquid developer of claim 7, wherein said solvent (A) has an SP value of not less than 8.5 and said solvent (B) has an SP value of less than 8.5.

9. A liquid developer produced by a process for production of claim 1.

* * * * *